US007329213B1

(12) United States Patent
Farley

(10) Patent No.: US 7,329,213 B1
(45) Date of Patent: Feb. 12, 2008

(54) EXERCISE MACHINE WITH COMPOUND ABDOMINAL MOVEMENT

(76) Inventor: Michael D. Farley, 217 Southtowne Pl. #AA116, South Milwaukee, WI (US) 53172

( * ) Notice: Subject to any disclaimer, the term of this patent is extended or adjusted under 35 U.S.C. 154(b) by 156 days.

(21) Appl. No.: 11/087,895

(22) Filed: Mar. 23, 2005

Related U.S. Application Data

(60) Provisional application No. 60/556,117, filed on Mar. 25, 2004.

(51) Int. Cl.
*A63B 26/00* (2006.01)

(52) U.S. Cl. ..... 482/140; 482/142

(58) Field of Classification Search ..... 482/140, 482/142; D21/676, 686, 690, 95–100, 135–138
See application file for complete search history.

(56) References Cited

U.S. PATENT DOCUMENTS

| | | | | |
|---|---|---|---|---|
| 5,147,259 | A | 9/1992 | Hutchins | |
| 5,263,914 | A | 11/1993 | Simonson et al. | |
| D362,281 | S | 9/1995 | Warehime et al. | |
| 5,573,485 | A | 11/1996 | Geschwender | |
| 5,725,463 | A | 3/1998 | Colonello et al. | |
| 5,746,688 | A | 5/1998 | Prager | |
| 5,871,425 | A | 2/1999 | Gvoich | |
| 6,022,303 | A | 2/2000 | Abdo | |
| 6,022,304 | A | 2/2000 | Tornabene et al. | |
| 6,030,323 | A | 2/2000 | Fontenot et al. | |
| 6,048,293 | A | 4/2000 | Lee | |
| D424,142 | S | 5/2000 | McBride et al. | |
| 6,113,522 | A | 9/2000 | Fontenot et al. | |
| 6,186,926 | B1 | 2/2001 | Ellis | |
| D439,938 | S | 4/2001 | Batca et al. | |
| 6,322,484 | B1 | 11/2001 | Muller | |
| 6,390,960 | B1 | 5/2002 | Boland | |
| 6,458,062 | B2 | 10/2002 | Conner | |
| 6,475,123 | B1 | 11/2002 | Evans | |
| 6,491,611 | B1 | 12/2002 | Stearns | |
| 6,966,872 | B2 * | 11/2005 | Eschenbach | 482/142 |
| 2001/0029223 | A1 | 10/2001 | Kaliassy | |
| 2002/0169057 | A1 | 11/2002 | Forcillo | |
| 2003/0050156 | A1 | 3/2003 | Tornabene | |
| 2003/0100415 | A1 | 5/2003 | Augustine et al. | |
| 2003/0130100 | A1 | 7/2003 | Perez | |

OTHER PUBLICATIONS http://www.thecoremaster.com/icon/core/3in1,html; CoreMaster. 3 in 1, Coremaster By Pro-Form, Mar. 29, 2005, 2005 Infomercial TV Inc., USA.

http://www.abscissor.com, Body By Jake—AB Scissor, Mar. 29, 2005, pp. 1-3, USA.

* cited by examiner

*Primary Examiner*—Lori Amerson
(74) *Attorney, Agent, or Firm*—Quarles & Brady LLP

(57) ABSTRACT

An exercise machine includes a frame having a horizontally extending seat mounted thereon. A foot restraint assembly is pivotally mounted about a first horizontal pivot axis to the frame. A motion translation arrangement has one end pivotally secured about a second horizontal pivot axis to the frame, and an opposite end extending beyond the frame. An arm, back and head support is pivotally secured about a third horizontal pivot axis to the opposite end of the motion translation arrangement and is moveable forwardly relative to the foot restraint assembly. The second horizontal pivot axis and the third horizontal pivot axis enable a sequential, compound, articulated abdominal exercise movement as the arm, back and head support is moved towards the foot restraint assembly.

22 Claims, 13 Drawing Sheets

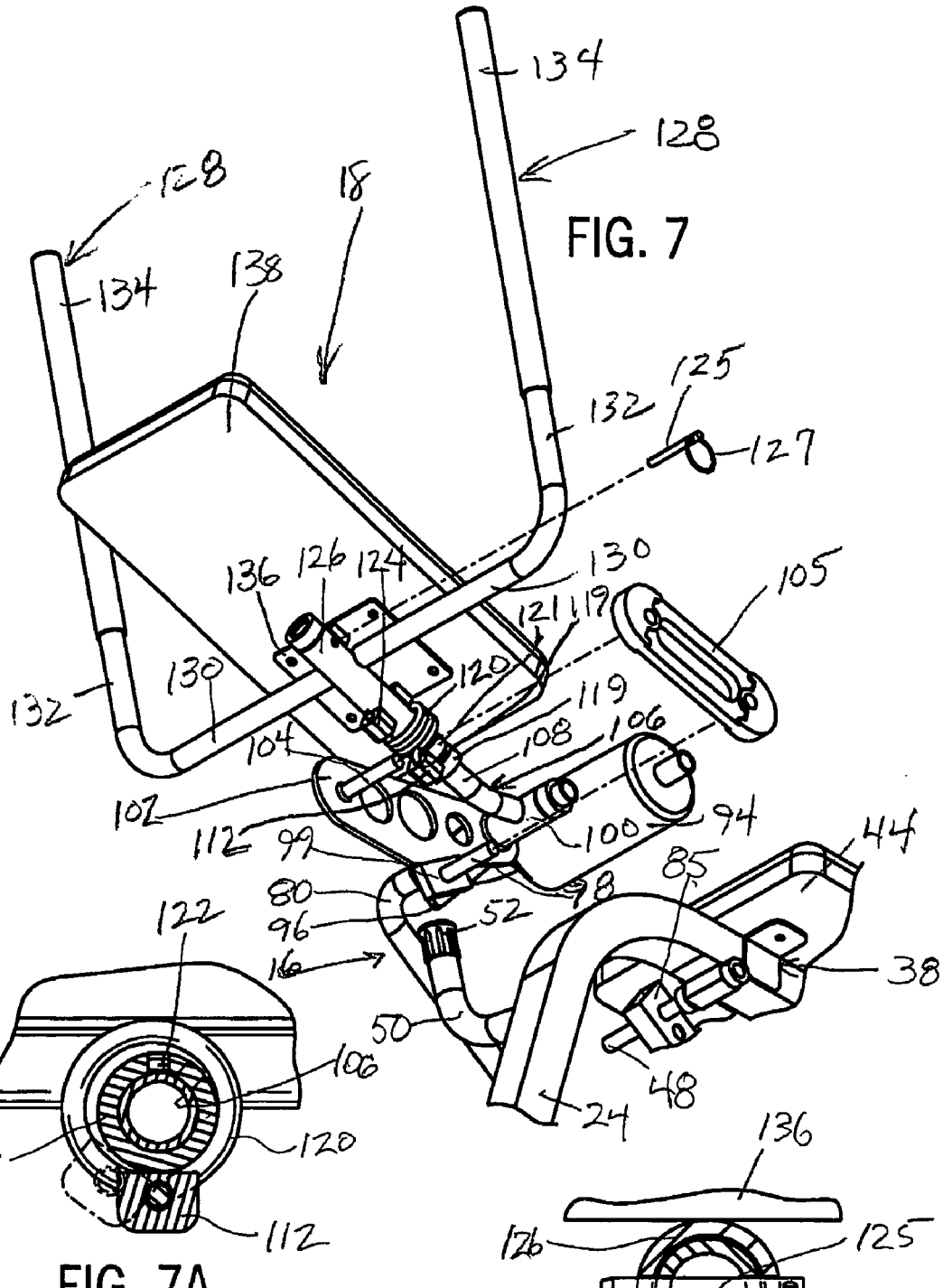
FIG. 7
FIG. 7A
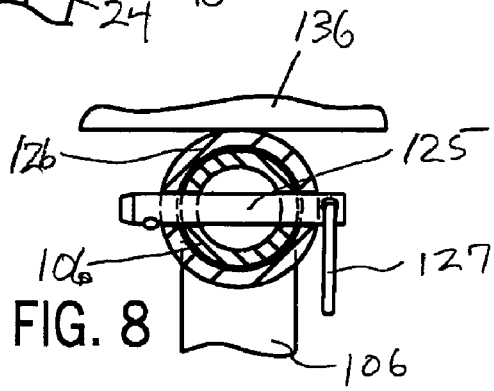
FIG. 8

EXERCISE MACHINE WITH COMPOUND ABDOMINAL MOVEMENT

CROSS-REFERENCE TO RELATED APPLICATIONS

This application is related to and claims priority from U.S. Patent Application Ser. No. 60/556,117 filed Mar. 25, 2004.

FIELD OF THE INVENTION

The present invention relates broadly to an exercise machine which permits exercise of upper abdominal muscles and lower abdominal muscles either separately or in combination with each other. More particularly, the present invention pertains to a more comprehensive exercise machine designed to improve the overall quality of abdominal exercise while also enabling proper support of one's back.

BACKGROUND OF THE INVENTION

Various exercise machines are known which purport to strengthen and tone the muscles of the abdominal region. Certain of these machines provide for exercising the upper and/or lower abdominals by moving about one or more horizontal pivot axes while pivoting the upper torso in one direction and pivoting the legs or knees in another direction. Other machines focus mainly on exercising the upper and side abdominals by allowing a bending and twisting movement. Some of these machines are reliant upon using the body weight of the exerciser, while others utilize some sort of fixed or adjustable resistance system to provide a working force against which an exerciser pulls during exercise of the abdominal muscles.

Despite the wide variety of abdominal exercise machines available to the public, most are designed for comfort and ease of use, and do not provide for highly efficient abdominal movements conducive to developing quality abdominal musculature while properly supporting one's back. In addition, many exercisers become bored or disinterested with the limited capability of today's abdominal exercise machines. Therefore, it is desirable to provide an exercise machine with total back support which overcomes the deficiencies and drawbacks of the prior art, and more efficiently works the upper, lower and oblique portions of one's abdominal area. Further, it is desirable to provide an exercise machine having an adjustable arrangement for presenting various types of resistance which will appeal to a variety of exercisers.

SUMMARY OF THE INVENTION

It is a general object of the present invention to provide an exercise machine for improving the health, well being and appearance of a wide range of exercisers.

It is a primary object of the present invention to provide an exercise machine for working, strengthening and developing the abdominal, as well as the back and leg muscles of the human body.

It is a chief object of the present invention to provide an exercise machine for enabling a sequential, compound, articulated abdominal movement.

It is one object of the present invention to provide an exercise machine for targeting the upper and lower abdominal muscles either independently or simultaneously together over a full range of motion.

It is also an object of the present invention to provide an exercise machine conveniently designed to enable an exerciser to perform crunching, reverse crunching and twisting abdominal movements with high efficiency.

It is another object of the present invention to provide an exercise machine constructed and arranged to enable exercise using no resistance, adjustable negative resistance or adjustable positive resistance.

It is a further object of the present invention to provide an exercise machine which supports the head and back during abdominal exercise movement.

Still another object of the present invention is to provide an exercise machine which is versatile and easy to use, yet will offer a more challenging exercising experience than previously known machines.

Yet another object of the present invention is to provide an exercise machine which will continually maintain the interest of the exerciser.

A further object of the present invention is to provide an exercise machine capable of home, clinical or commercial gym use.

In one aspect of the invention, an exercise machine includes a frame having a horizontally extending seat mounted thereon. A foot restraint assembly is pivotally mounted about a first horizontal pivot axis to the frame. A motion translation arrangement has one end pivotally secured about a second horizontal pivot axis to the frame, and an opposite end extending beyond the frame. An arm, back and head support is pivotally joined about a third horizontal pivot axis to the opposite end of the motion translation arrangement and is moveable back and forth relative to the foot restraint assembly. The second horizontal pivot axis and the third horizontal pivot axis enable a sequential, compound, articulated abdominal exercise movement as the arm, back and head support is moved toward the foot restraint assembly.

Only the arm, back and head support is moved during a first stage of abdominal exercise and both the arm, back and head support and the motion translation arrangement are moved together during a second stage of abdominal exercise. The arm, back and head support is pivotally connected about a moving pivot axis to the motion translation arrangement for providing a twisting abdominal exercise movement. The moving pivot axis is substantially perpendicular to the third horizontal pivot axis. The foot restraint assembly is in engagement with the feet of the exerciser for allowing the knees of the exerciser to be moved relative to an upper torso of the exerciser and for providing a lower abdominal exercise movement. The arm, back and head support and the foot restraint assembly are pivotable about their respective axes either independently of each other to provide upper or lower abdominal exercise, or simultaneously with each other to provide combined upper and lower abdominal exercise.

Various other objects, features and advantages of the invention will be made apparent from the following description taken together with the drawings.

BRIEF DESCRIPTION OF THE SEVERAL VIEWS OF THE DRAWINGS

The drawings illustrate the best mode presently contemplated of carrying out the invention.

In the drawings:

FIG. 7 is an enlarged, fragmentary rear perspective view of the exercise machine shown in FIG. 1;

FIG. 7A is an enlarged sectional view of a spring mounting arrangement taken on line 7A-7A of FIG. 2;

FIG. 8 is an enlarged, sectional view taken on line 8-8 of FIG. 2;

DETAILED DESCRIPTION OF THE INVENTION

Figure 1:
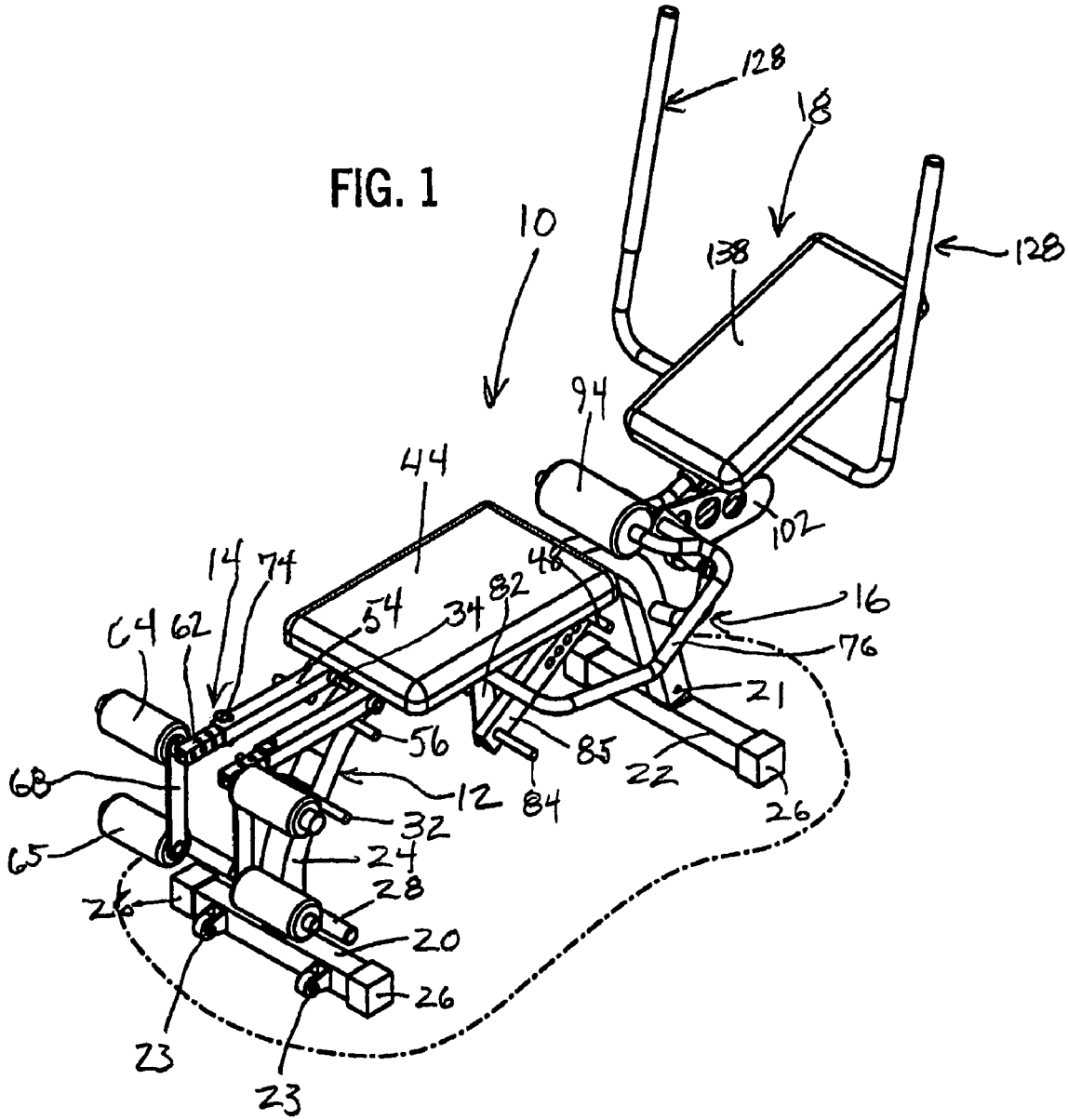
FIG. 1 is a front perspective view of the exercise machine embodying the present invention in an unfolded operating position.

Referring now to the drawings, FIGS. 1-7 illustrate an exercise machine 10 in accordance with the present invention. Generally, the exercise machine 10 is comprised of a rigid frame 12, a foot restraint assembly 14, a motion translation arrangement 16 and an arm, back and head support 18. As will be fully understood below, the major components 12, 14, 16 and 18 define a versatile exercise machine which provides comprehensive and sequential, compound abdominal exercise in addition to exercise of back, leg and glute muscles. Of key importance is the ability of the exercise machine 10 to enable crunching, reverse crunching and twisting motion in various combinations when performing upper and lower abdominal exercise while properly supporting an exerciser's back.

Figure 5:
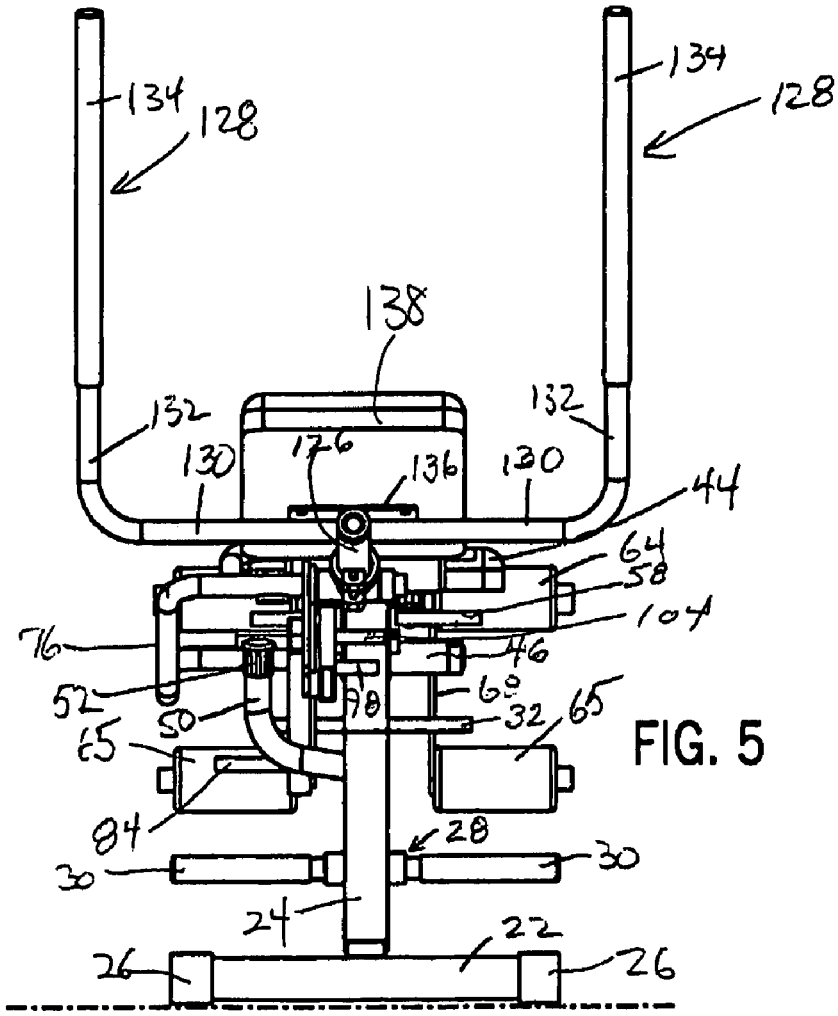
FIG. 5 is a view taken from the right side of FIG. 2.
Figure 6:
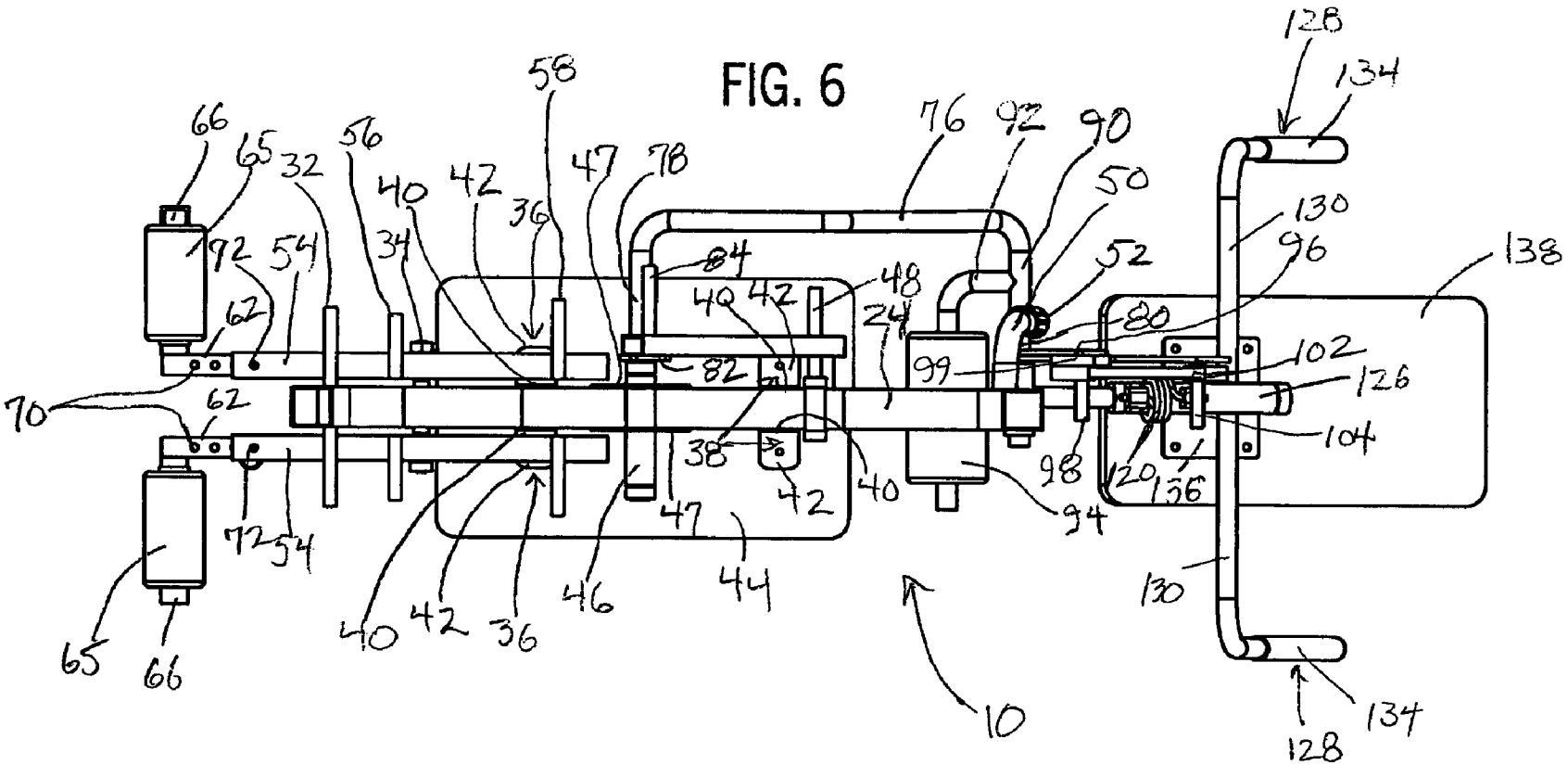
FIG. 6 is a bottom view of the exercise machine as taken on line 6-6 of FIG. 2.

Frame 12 includes a front transverse member 20 and a rear transverse member 22 rigidly interconnected by an arched bridging member 24. The transverse members 20, 22 may be welded integrally to the frame 12 or can be attached to the bottom thereof by fasteners 21. A set of wheels 23 is affixed to the front transverse member 20 to enable movability of the machine 10 when the rear portion of the frame 12 is lifted. Opposite end portions of the transverse members 20, 22 are provided with slide-resistant caps 26 to provide stability to the machine 10. A footrest 28 is fixed across a front end of the bridging member 24 and includes slip-resistant coverings 30 on opposite ends thereof as best seen in FIG. 5. Located above the footrest 28 and also fixed transversely to the front end of the bridging member 24 is a first retaining bar 32 used to mount one of several resistance members to be discussed below. A first pivot pin 34 defining a first horizontal pivot axis A (FIG. 2) is secured to and across the bridging member 24 at a locus spaced above and rearwardly of the retaining bar 32. The pivot pin 34 functions to provide pivotal movement for the foot restraint assembly 14. Referring to FIG. 6, a pair of front L-shaped mounting brackets 36 and a pair of rear, L-shaped mounting brackets 38 have vertical portions 40 which are anchored to the sides of the bridging member 24 along an upper portion thereof. The mounting brackets 36, 38 further have horizontal portions 42 which are used to fix a cushioned seat 44 in place along the top of the bridging member 24 by fasteners or the like. A tubular sleeve 46 is fixedly supported by a pair of mounting plates 47 rigidly attached to opposite sides of bridging member 24 between the mounting brackets 38, 40. A second retaining bar 48 is secured to the underside of bridging member 24 rearwardly of mounting brackets 38. A curved tubular member 50 has a proximal end joined to a rearward end of bridging member 24, and an opposite, distal end provided with a cap 52. The member 50 provides a brace for supporting a rear portion of the motion translation arrangement 16 as clearly shown in FIGS. 10-17.

The foot restraint assembly 14 includes a pair of identical, tubular outer members 54, each having elongated third and fourth retaining bars 56, 58 which project outwardly therefrom. Both outer members 54 are mounted on opposite ends of pivot pin 34 using a series of bearing assemblies 60 to enable the outer members 54 to freely swing on pivot pin 34. As seen in FIG. 6, rearward ends of the outer members 54 normally engage the forwardmost horizontal portions 42 of mounting brackets 36 so that the outer members 54 extend forwardly of frame 12. The outer members 54 slidably receive tubular inner members 62 having upper and lower foot restraint rollers 64, 65 that are mounted on shafts 66 and connected by links 68. The top end of each link 68 is pivotally attached to the outer end of each inner member 62. The foot restraint rollers 64, 65 are preferably engaged by the upper and lower portions of an exerciser's shoes or feet. The inner members 62 are formed with a series of holes 70, each of which is to be aligned with an aperture 72 (FIG. 6) in a respective outer member 54 to enable adjustable length positioning for the feet depending on the size of the exerciser. Retaining pins 74 (FIGS. 1 and 2) are passed through the aligned hole 70 and aperture 72 to fix a desired position for the particularly sized exerciser. Each pair of outer members 54 and inner members 62 form pivoting levers which, when engaged by the exerciser's feet, permit one's knees to be drawn towards and away from one's upper body either separately or together so as to provide isolated lower abdominal exercise.

The motion translation arrangement 16 includes a curved and bent arm 76 having a forward end 78 rotatably received in the sleeve 46 on the underside of frame 12. The forward end 78 swings about a second horizontal pivot axis B (FIG. 2) defined by the longitudinal axis of sleeve 46. The pivotal movement of arm 76 helps provide one portion of a sequential, compound abdominal exercise movement which is a key feature of the present invention. The curved and bent arm 76 has a rearward end 80 on which the arm, back and head support 18 is pivotally mounted. The rearward end 80 is supported by the capped member or brace 50 on frame 12.

The forward end 78 carries a downwardly extending first plate 82 having a fifth retaining bar 84 on one side. Retaining bars 48 and 84 can be used to mount a rigid brace 85 (FIG. 2) having various holes 87 for a purpose to be explained hereafter. A rearward portion 90 has a tubular extension 92 for mounting a cylindrical support cushion 94 designed to support the exerciser's buttocks and lower back when the exerciser is positioned on the seat 44. The rearward end 80 further has a downwardly extending second plate 96 having a sixth retaining bar 98 extending therefrom. A stop block 99 is fixed on the retaining bar 98 against plate 96, as best seen in FIG. 7.

Figure 2:
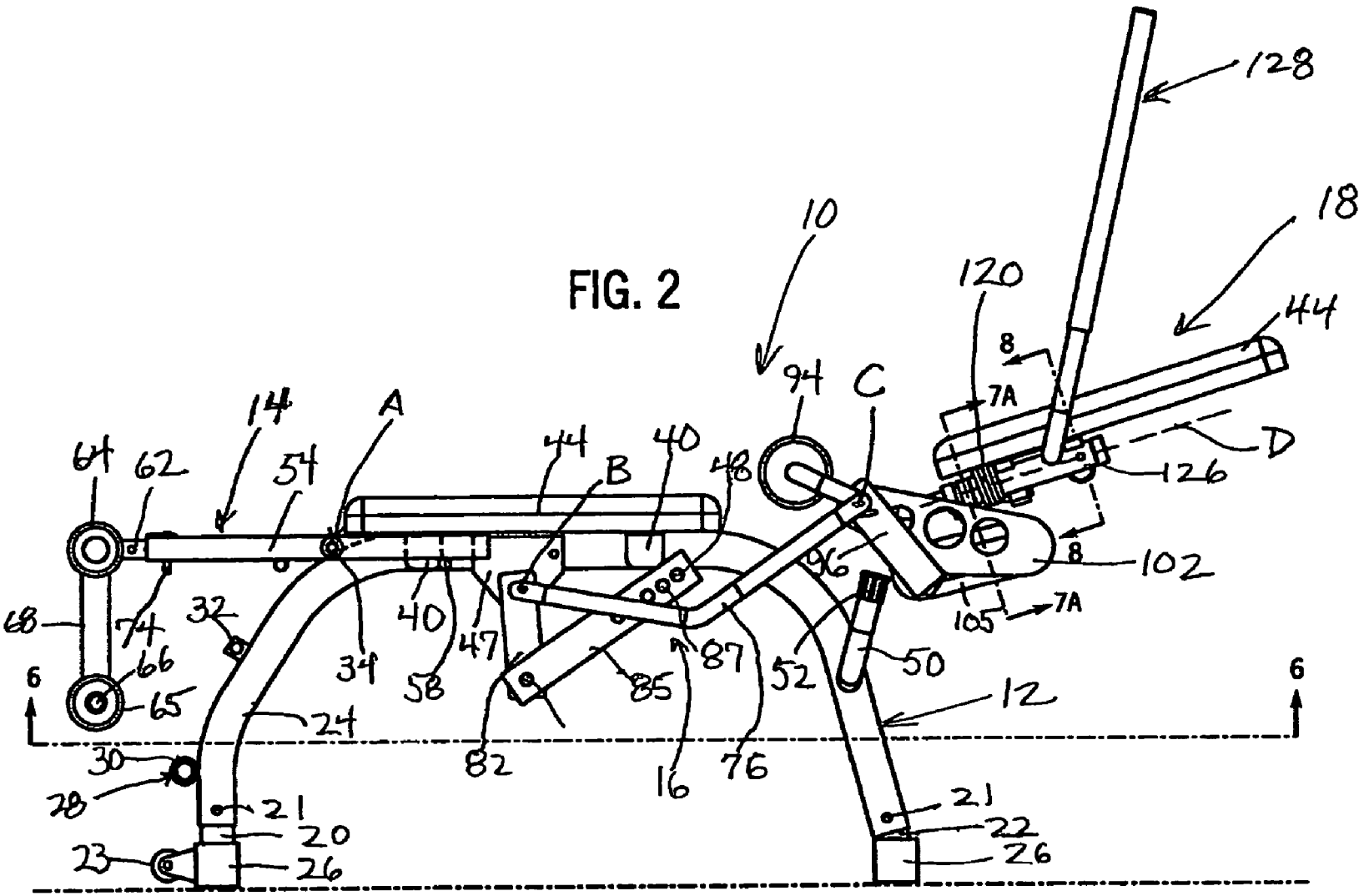
FIG. 2 is a front elevational view of the exercise machine shown in FIG. 1.
Figure 3:
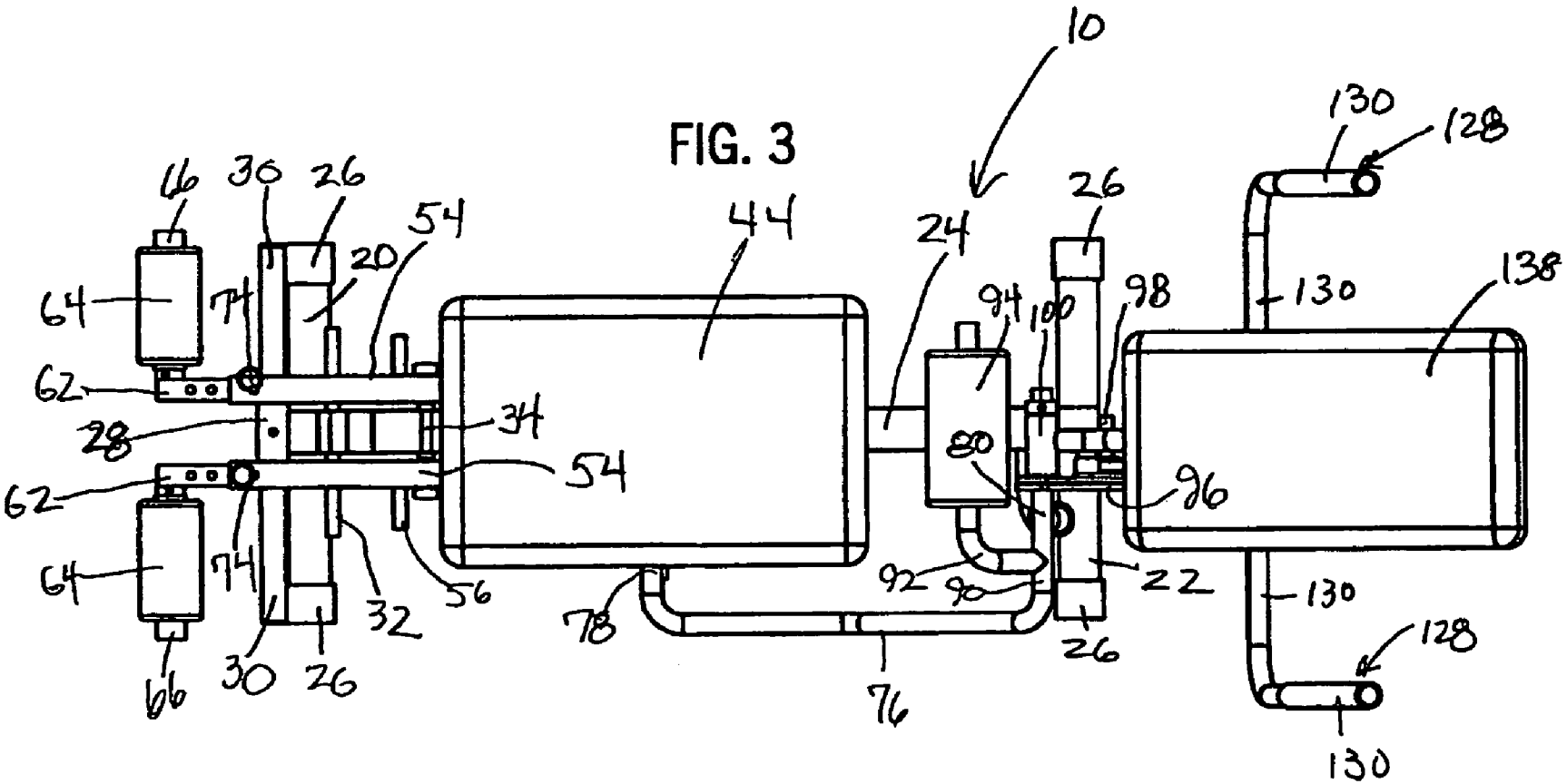
FIG. 3 is a top view of the exercise machine shown in FIG. 2.
Figure 4:
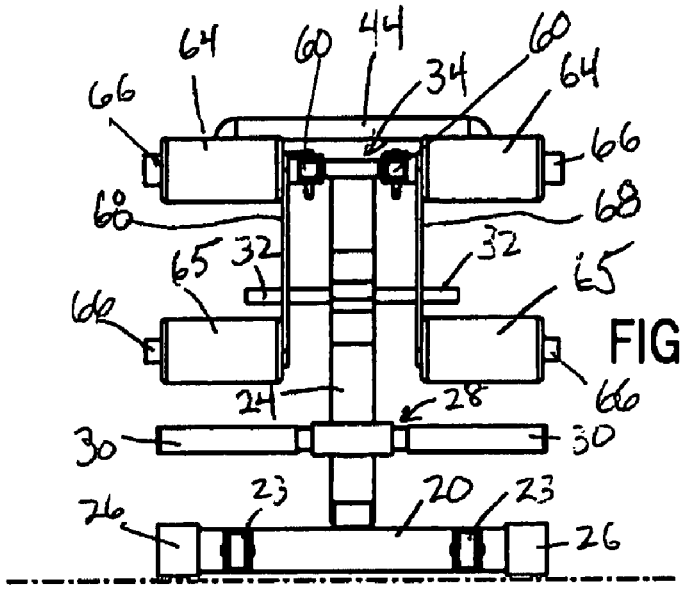
FIG. 4 is a view taken from the left side of FIG. 2.

The arm, back and head support 18 includes a cylindrical sleeve 100 which is rotatably mounted on the rearward end 80 of curved arm 76 about a third horizontal pivot axis C (FIG. 2). Such rotary travel of arm, back and head support 18 provides another portion of the sequential, compound abdominal exercise movement. The rotatable sleeve 100 is welded to a materially-relieved brace 102 which carries a seventh retaining bar 104 on its outer end. Retaining bars 98 and 104 are used to mount a resistance band 105 (FIG. 7). Integrally attached to the sleeve 100 is an upwardly extending, tubular arm 106 having a lower portion 108 and an upper portion 110 (FIG. 8). Lower portion 108 is provided with a first spring retainer 112 which receives one end of a coil spring 120 that is wrapped around the lower portion of an elongated, hollow cylindrical tube 126. An opposite end of spring 120 is held in a second spring retainer 124 which is attached to the outer surface of cylindrical tube 126. The spring retainers 112, 124 receive set screws (not shown) to lock the spring ends in place and maintain a quiet operation. As best seen in FIG. 7A, a first collar 119 is welded to the tubular arm 106. A second collar 121 integral with the spring retainer 112 is rotatably mounted on tubular arm 106. The collar 121 carries a set screw 122 to normally lock the spring retainer 112 in proper position upon spring installation. However, upon aging of the spring 120, the loosening and tightening of the set screw 122 will conveniently allow the collar 121 and spring retainer 112 to be adjusted as shown in phantom lines so that the proper spring setting is maintained. Tube 126 is pivotally mounted on the upper portion 110 of arm 106 about a moving pivot axis D (FIG. 2) which is substantially transverse to the third horizontal pivot axis defined by rearward end 80 of arm 76. The moving pivot axis allows selective side-to-side or twisting motion to be used during abdominal exercise with machine 10. A self-locking pin 125 having a finger ring 127 (FIG. 8) may be inserted through aligned holes in the upper portion 110 of arm 106 and the tube 126 when it is desired to prevent twisting motion of the support 18. A pair of handles 128 has first segments 130 extending laterally from opposite sides of the tube 126 and second segments 132 projecting away therefrom. In the preferred embodiment as seen in FIG. 7, these second segments 132 are shown oriented at substantially 90 degrees relative to the first segment 130 but it should be understood that the second segments could be angled outwardly and shaped as desired. A substantial length of each second segment 132 is provided with a slip-resistant, grip-enhancing covering 134 which is securely retained in the hands of the exerciser. Tube 126 and first handle segments 130 are fixed to a support plate 136 joined to the rear of a cushioned pad 138 for supporting one's back and head.

Figure 9:
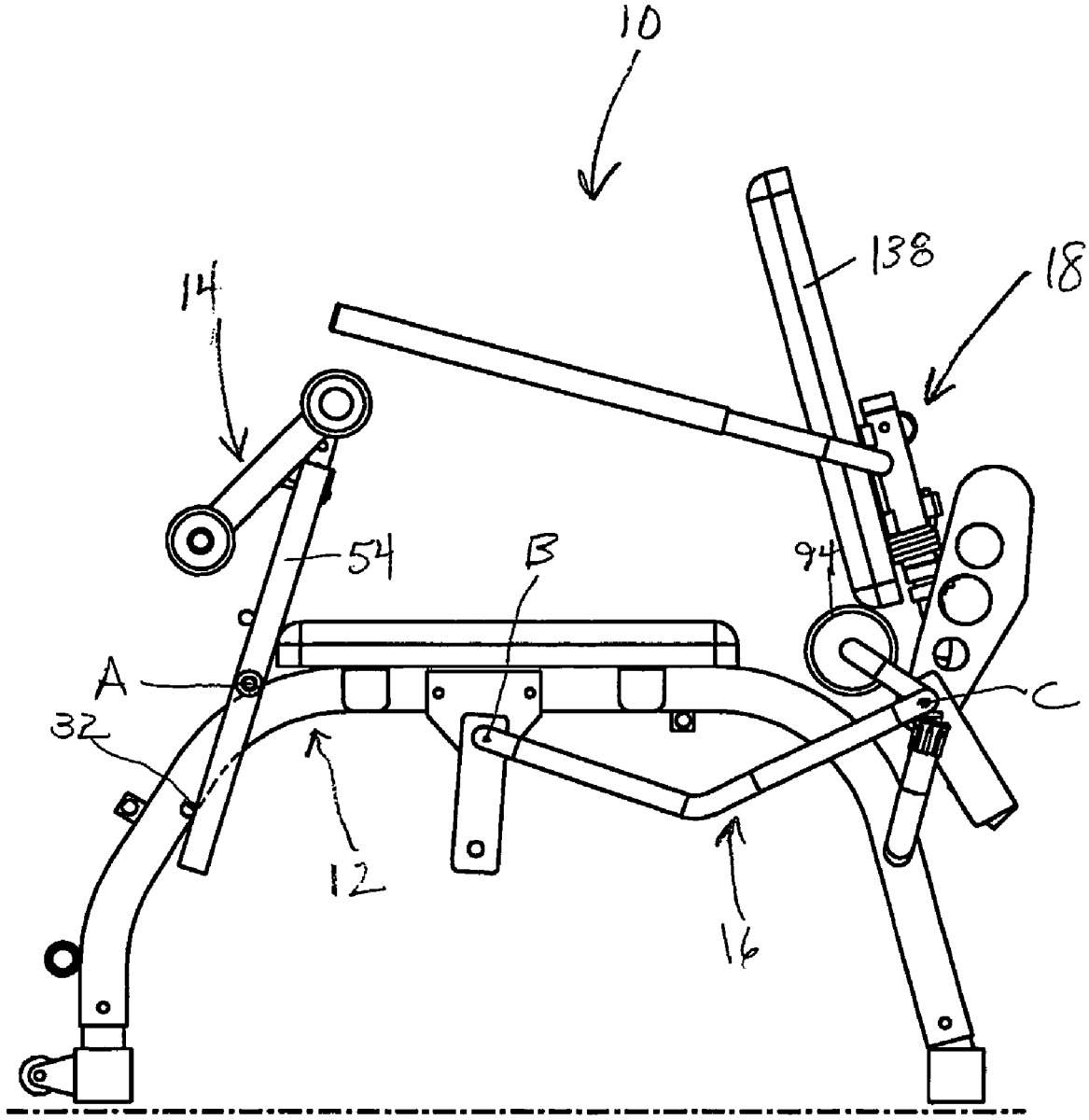
FIG. 9 is a front elevational view of the exercise machine in a folded storage condition.

FIG. 9 shows the exercise machine 10 in a compact storage position in which the foot restraint assembly 14 is folded rearwardly about horizontal pivot axis A and the arm, ball and head support 18 is folded forwardly about horizontal pivot axis C. The foot restraint assembly 14 is held in its position by means of the rearward ends of outer members 54 engaging the retaining bar 32 on frame 12. The arm, back and head support 18 is retained in its position due to the contact of the pad 138 with the support cushion 94 on motion translation arrangement 16.

In preface to the detailed operation to follow, it should be understood that the exercise machine 10 of the present invention is designed for a wide range of exercisers and, as such, is intended to be used with no resistance, with adjustable negative resistance when performing a pulling motion, or with adjustable positive resistance when performing a pushing motion. The latter type of resistance creates a "lift assist" mode which is especially convenient for those exercisers being introduced to abdominal exercise or those exercisers who require, for whatever reason, an additional level of assistance in performing abdominal exercise. In addition, the positive resistance mode may be also utilized to present a variety of non-abdominal exercise movements which further enhance the versatility of the machine.

Figure 10:
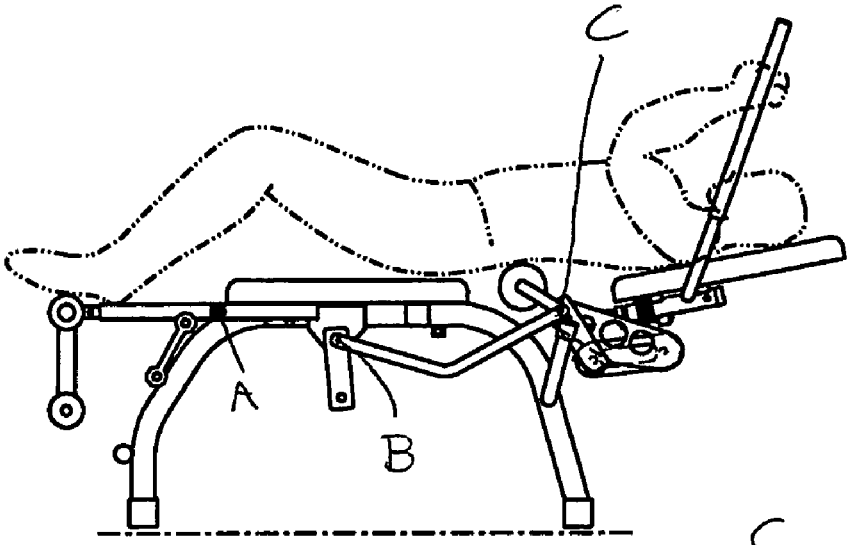
FIGS. 10 and 11 are operational views of an exerciser performing upper abdominal exercise on the exercise machine.

In use, the exercise machine 10 is unfolded from the storage condition shown in FIG. 9, and is ready to be used with no resistance, or as depicted in FIG. 10-26 upon the simple installation of one or more resistance members 105. The resistance members are shown preferably as long lasting, elastic bands, but could be embodied by other suitable forms. Various elastic bands are supplied with the machine 10, each being of a particular resistance and/or size to be used as desired by the individual exerciser to fit his or her requirements or capabilities. In FIG. 10, the arm, back and head support 18 is maintained in its lowermost position by contact between the brace 85 and the stop block 99.

In FIGS. 10-13 and 15-26, first and second elastic bands 105*a* (seen most clearly in FIG. 13) are placed in position for a leg pulling motion between the foot restraint assembly 14 and the frame 12. Each elastic band 105 commonly includes opposed holes so that the bands 105 are quickly and slidably pushed onto each side of retaining bar 32 on frame 12, and each retaining bar 56 on foot restraint assembly 14. A third elastic band 105*b* is similarly installed for an upper torso pulling motion between retaining bar 98 on motion translation arrangement 16 and retaining bar 104 on the arm, back and head support 18. Retainers (not shown) may be used to hold the bands 105*a, b* in place.

Figure 11:
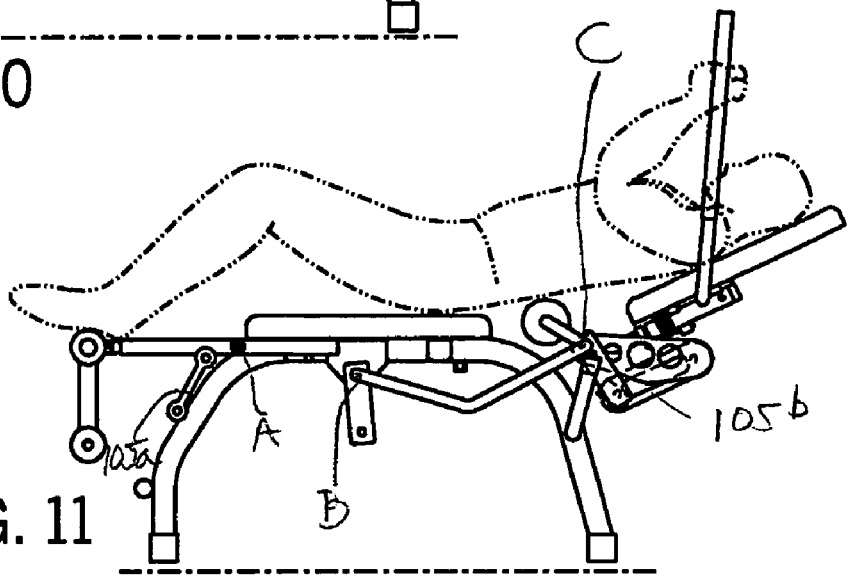

FIGS. 10 and 11 illustrate an exerciser performing an abdominal crunch with one's feet raised and supported on foot restraint rollers 64. In FIG. 10, the exerciser has positioned one's buttocks or lower back against support cushion 94, and placed one's head and upper back against cushioned pad 138 with one's hands on handle coverings 134. The exerciser moves forwardly so that the arm, back and head support 18 pivots about horizontal pivot axis C and pulls against the resistance of elastic band 105*b*. As the exerciser moves from the position of FIG. 10 to the position of FIG. 11, all forward pivotal movement occurs about horizontal pivot axis C only as motion translation arrangement 16 remains stationary. As a result, the pivot axis C enables a first stage of sequential, compound, upper abdominal exercise movement. The exerciser may choose to move back and forth between the positions of FIGS. 10 and 11, or may move further forwardly to a more pronounced crunch position. Throughout the duration of the abdominal movement, the exerciser is supported by cushion 94 and pad 138.

Figure 12:
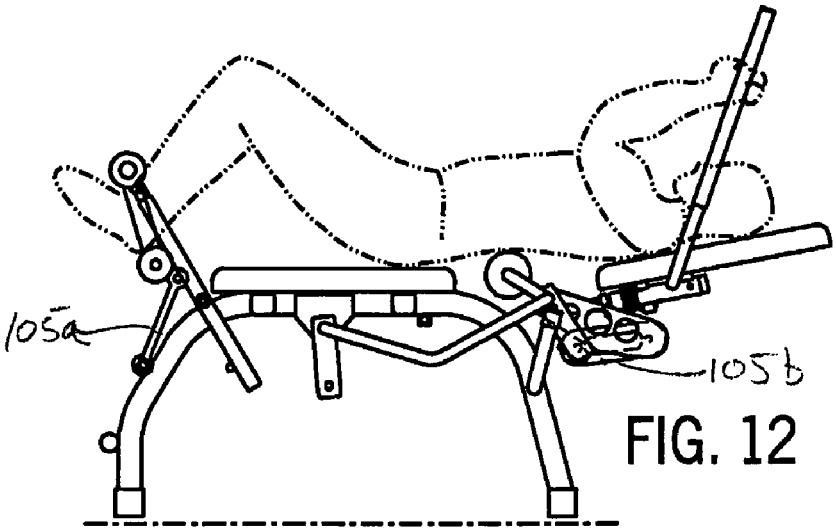
FIGS. 12 and 13 are operational views of the exerciser performing lower abdominal exercise on the exercise machine.
Figure 13:
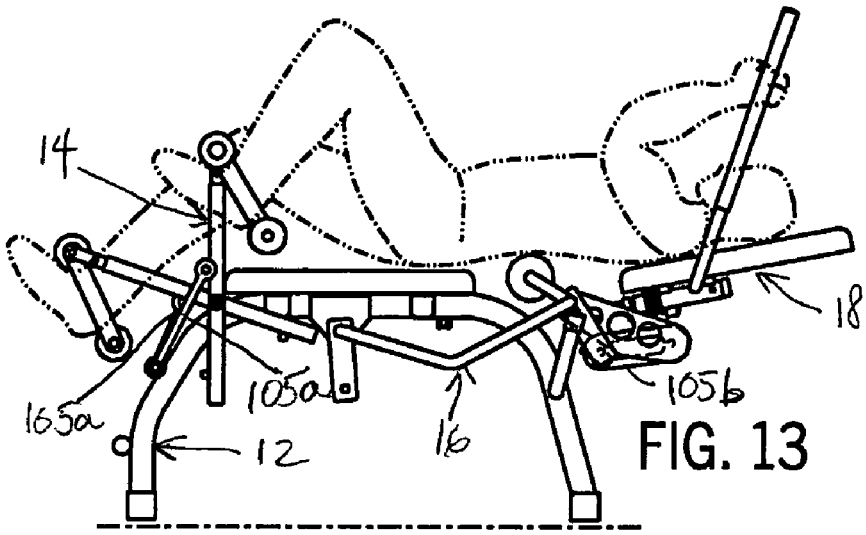

In FIGS. 12 and 13, the exerciser's upper torso is substantially maintained in the stationary position of FIG. 10 while the exerciser's legs and knees are pulled towards the chest against the resistance of elastic bands 105*a* attached to the foot restraint assembly 14 which turns about pivot axis A. The exerciser's legs and knees are then returned to their original position. Such movement is commonly known as a reverse crunch. This motion whether performed with both legs together (FIG. 12) or alternating each leg (FIG. 13), specifically targets the lower abdominal region of the exerciser.

Figure 15:
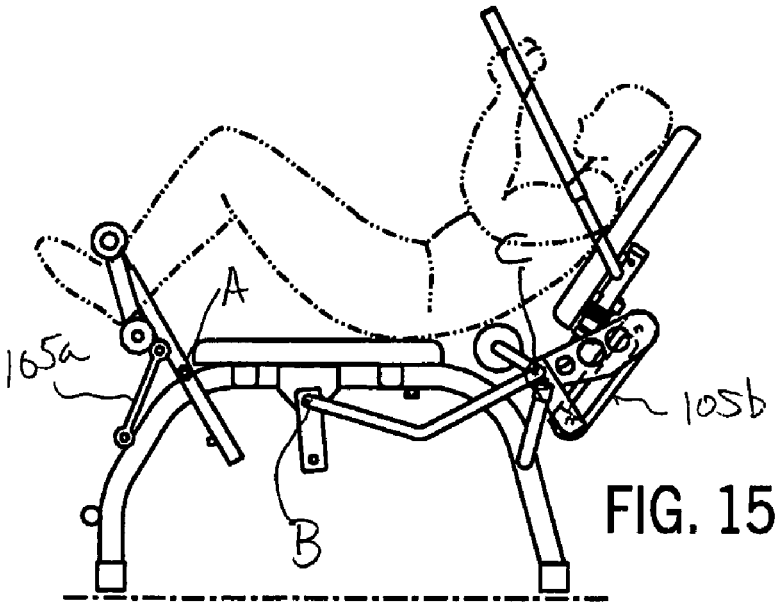
FIG. 15 is an operational view of the exerciser performing a combination of upper and lower abdominal exercise on the exercise machine.
Figure 16:
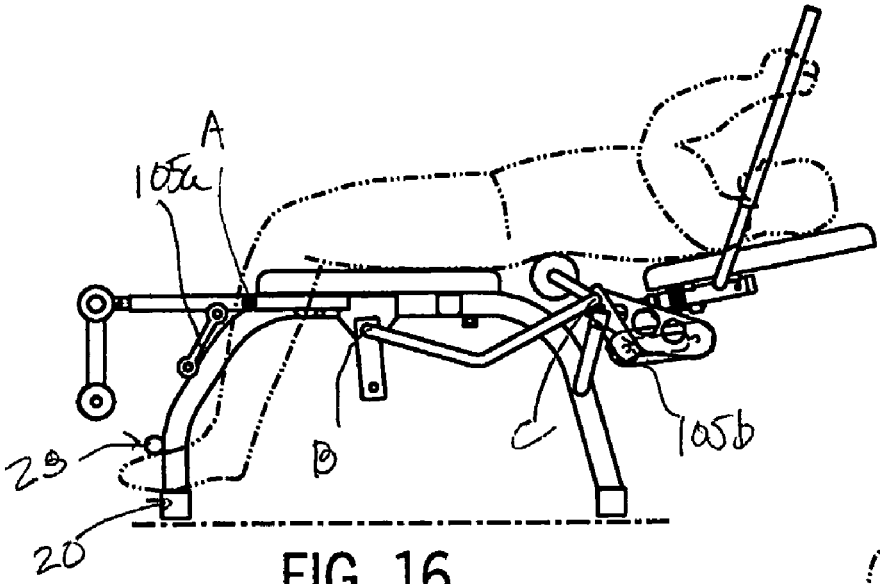
FIGS. 16, 17, 18 and 19 are operational views of the exerciser performing further upper abdominal exercise on the exercise machine.
Figure 17:
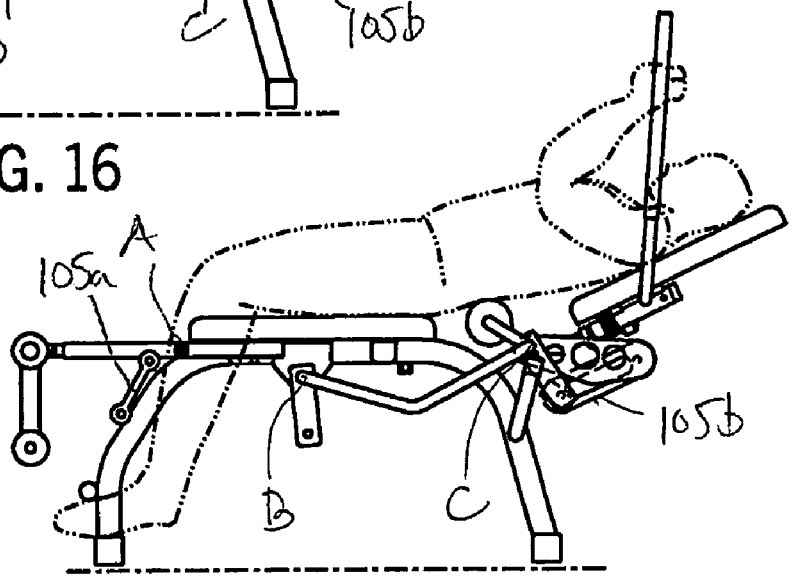
Figure 18:
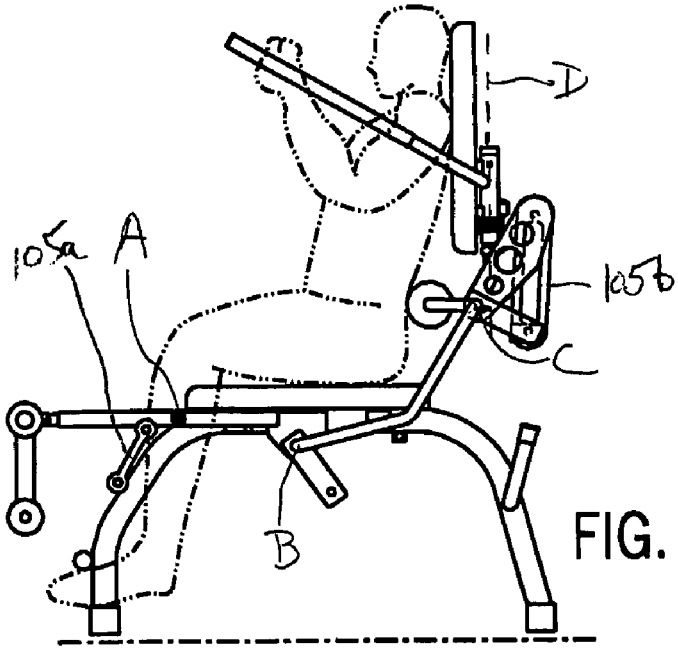
Figure 19:
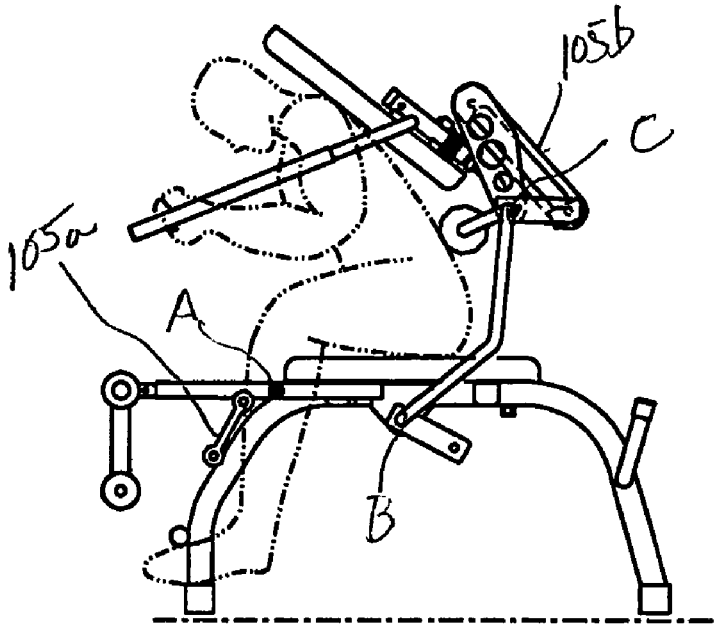

In FIG. 15, the exerciser is shown working both the upper and lower abdominal muscles simultaneously by combining an advanced movement of the upper abdominal movement of FIG. 11 with the lower abdominal movement of FIG. 12. In can be seen that the exerciser assumes a "jack knife" position as the upper torso is pulled against the elastic band 105*b* while the legs and knees are pulled against bands 105*a*. Moving back and forth into and out of the jack knife position provides an intensely, and efficient exercising motion.

FIGS. 16, 17, 18 and 19 demonstrate a sequence of upper abdominal movements somewhat analogous to those in FIGS. 10-12. However, in this case, the exerciser's feet are held at a lower position between the front transverse member 20 of frame 12 and the footrest 28. In moving from the position of FIG. 16 to the position of FIG. 19, the exerciser not only pulls against elastic band 105*b* but also overcomes the weight of the arm, back and head support 18 pulling the same forward so that the motion translation arrangement 16 pivots about horizontal axis B. That is, the pivot axis B enables a second stage of sequential, compound upper abdominal exercise movement so that a highly efficient crunch is attained. It is believed that this two-stage, sequential compound movement is a most important aspect of the invention which allows for superior upper abdominal movement in a manner previously unknown when performing in a backward and forward motion. With the feet now lowered, the exerciser is able to reach an even more contracted crunch position in FIG. 19 due to the pivoting travel of motion translation arrangement 16. The design of the exercise machine 10 provides for an extremely full range of abdominal motion between the starting position of FIG. 16 and the finished crunch position of FIG. 19.

Figure 20:
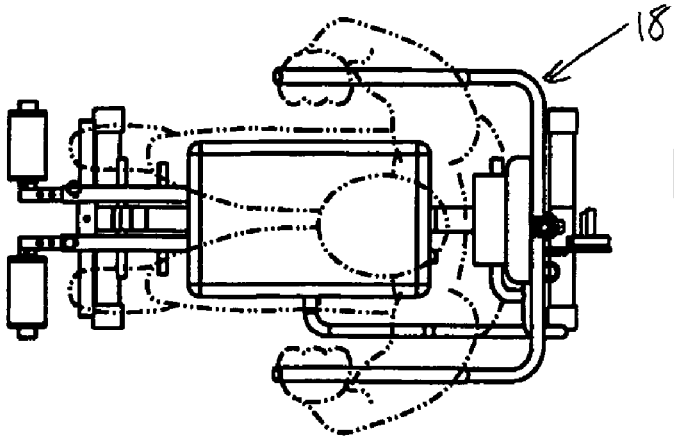
FIG. 20 is an operational view of the exerciser as seen from the top of the exercise machine.
Figure 21:
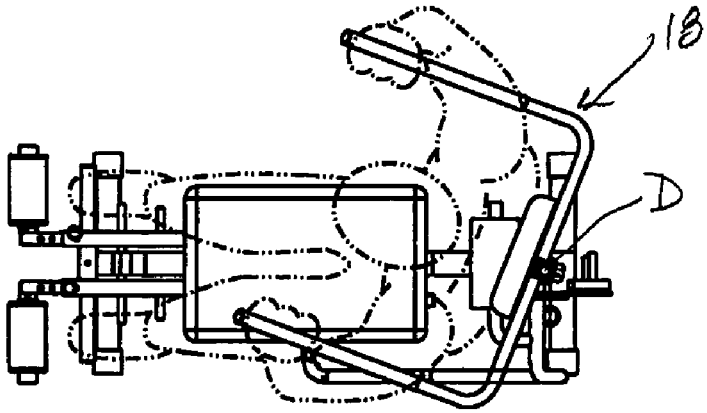
FIG. 21 is an operational view of the exerciser shown in FIG. 20 performing twisting abdominal exercise.

FIG. 20 is a top view which portrays the exerciser in a sit up position substantially 90 degrees relative to the seat 44. It is another important feature of the invention that an exerciser, without any additional adjustment on the machine, is able to perform twisting, side-to-side abdominal exercise, as shown in FIG. 21, so as to develop the oblique abdominal muscles. This twisting motion is made possible due to the spring 120 and due to the pivotal movement about pivot axis D (FIGS. 18 and 21) located behind the arm, back and head support 18. While the twisting motion is illustrated for an exerciser in the position of FIG. 21, it should be fully understood that the twisting motion is available to the exerciser throughout most of the entire range of abdominal movement since pivot axis D is a moving axis. As a result, the exerciser is able to perform twisting movements separately, or more effectively, in combination with the other upper and lower abdominal exercise movements described above.

Figure 22:
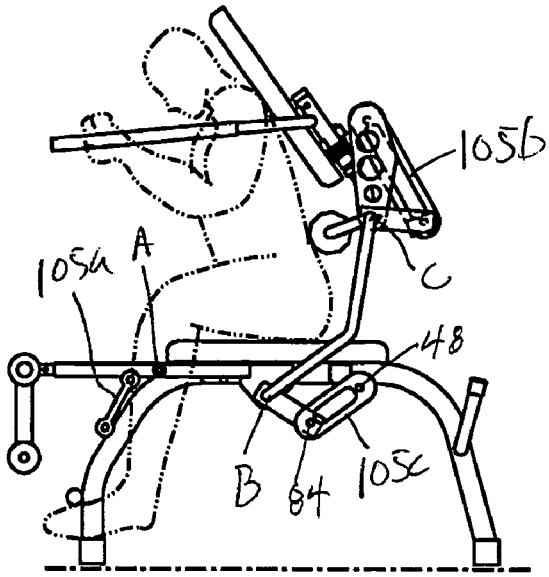
FIGS. 22, 23 and 24 are operational views of the exerciser performing back/upper abdominal exercise with the enabling assistance of the exercise machine.
Figure 23:
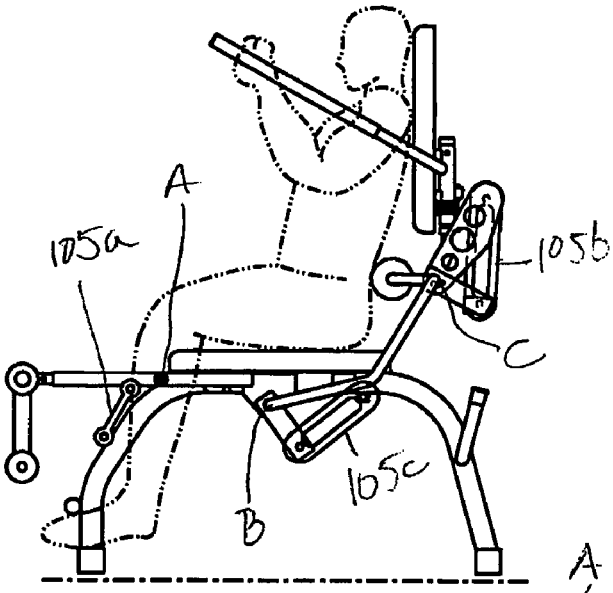
Figure 24:
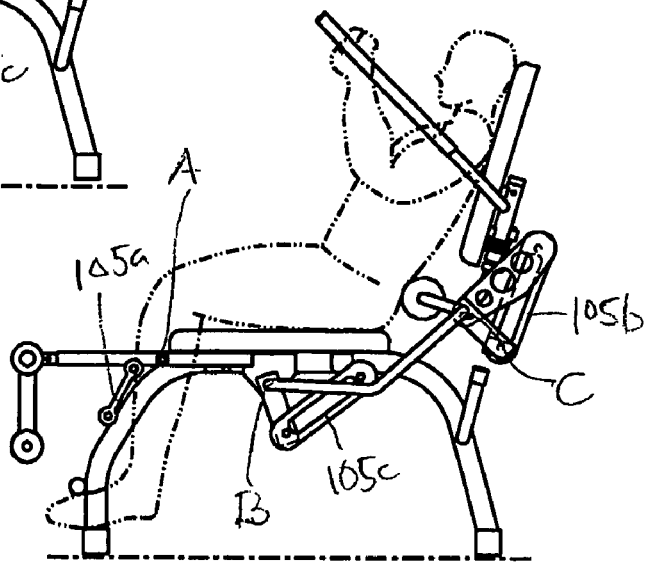

FIGS. 22, 23 and 24 represent examples of using the exercise machine 10 in a manner which will assist the exerciser performing an abdominal movement. In this assist mode, a further elastic band 105*c* is positioned between retaining bar 48 on the underside of frame 12 and retaining bar 84 on the forward end 78 of motion translation arrangement 16. Installation of this elastic band 105*c* will reposition the motion translation arrangement 16 and the arm, back and head support 18 in a raised position shown in FIG. 22. With elastic band 105*c* in position, the exerciser moves back and forth about pivot axis B among the positions of FIGS. 22, 23 and 24. As the exerciser moves rearwardly pulling the band 105*c*, the back muscles are also exercised. When rearward movement ceases, the elastic band 105*c* will help pull the exerciser forwardly thereby assisting in an abdominal movement. This positive resistance mode will be particularly useful for certain exercisers such as beginning exercisers, those recovering from injury and the elderly who need or desire assistance. Those exercisers wishing to strengthen their back can conveniently do so by increasing the number of elastic bands 105*c*.

Figure 14:
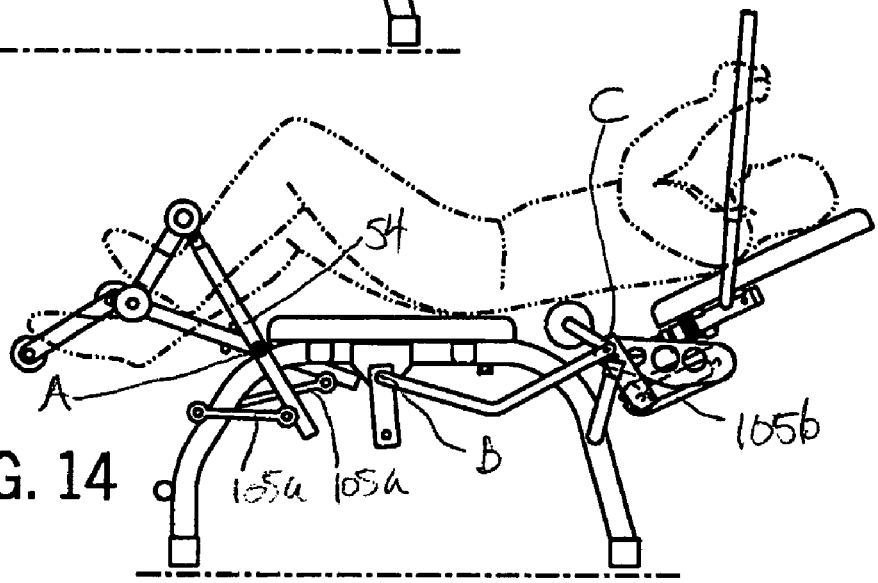
FIG. 14 is an operational view of the exerciser performing a leg press movement.

FIG. 14 shows an exerciser using the exercise machine 10 to target the leg and glute muscles. Here, the elastic bands 105*a* are repositioned from that shown in FIGS. 10-13 so that the rearward portions of the elastic bands 105*a* are installed on retaining bars 58 of outer members 54. With this change, the pivoting levers 54, 62 and the foot restraint rollers 64 of the foot restraint assembly 14 are raised to enable the exerciser to perform alternate leg pressing movements about pivot axis A. If desired, the exerciser could perform these pressing movements together in unison. In this positive resistance mode, the exerciser may be stabilized by locking the support 18 against twisting movement using pin 125 (FIG. 7).

Figure 25:
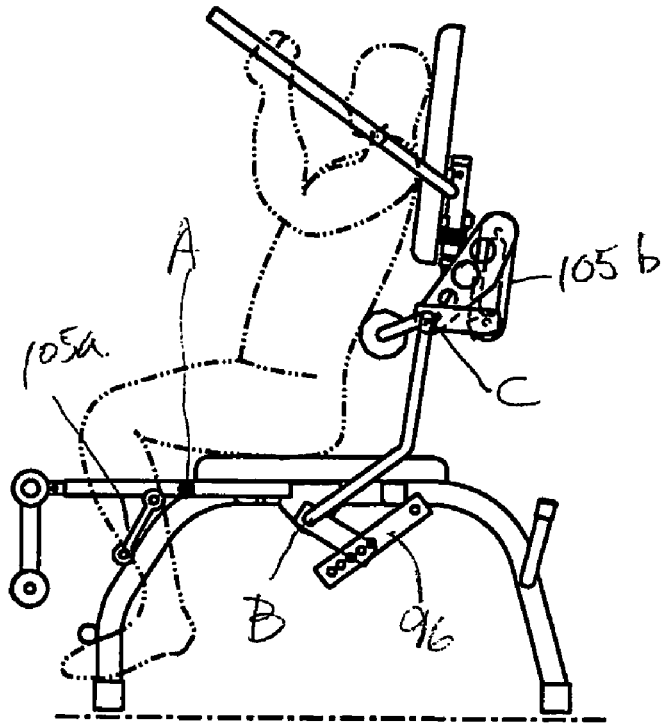
FIGS. 25 and 26 are operational views of the exerciser performing upper abdominal exercise from an upright position.
Figure 26:
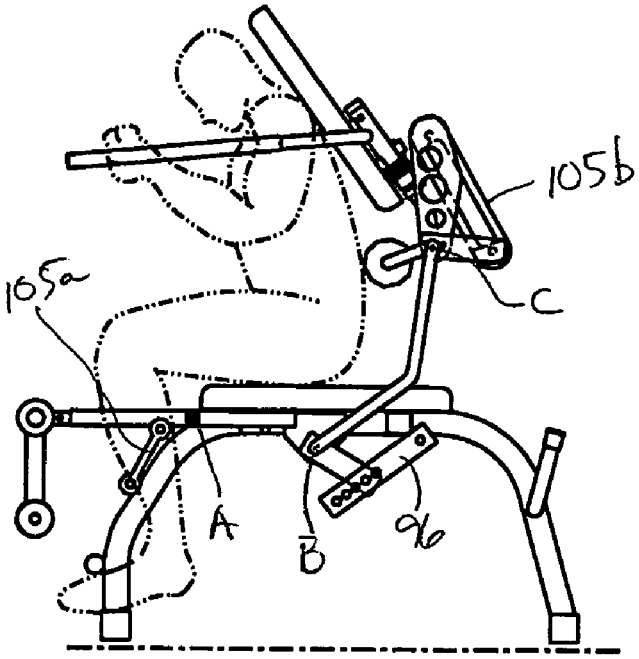

FIGS. 25 and 26 show an exerciser in a negative resistance mode performing upper abdominal exercise while the support 18 is held upright by brace 99.

The present invention thus provides a remarkedly versatile, multifunctional exercise machine 10 which is designed to continually maintain the interest of an exerciser, and to target the entire abdominal region by using a full range of crunching, reverse crunching and twisting motion either in separate or combination movements and with no resistance, with negative resistance or with positive resistance as desired. Resistance levels are easily established and adjusted by slidable installation and removal of elastic bands. Upper abdominal movement is particularly enhanced by the provision of sequential, compound articulation. It has been found that during abdominal exercise, one's back is properly supported particularly due to the cylindrical back support cushion 94 which maintains contact with key vertebrae in the lowermost portion of the spine.

Although not illustrated, it is contemplated that there may be further refinements, improvements and applications within the purview of the invention. For example, the machine 10 may be used to also exercise one's shoulder, chest, back, bicep and tricep muscles by using the foot restraint assembly 14, or the arm, back and head support 18.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

I claim:

1. An abdominal exercise machine comprising:

a frame supporting a seat forming a first plane;

at least one support bar extending from a first end to a second end and mounted to the frame through a first pivot axis extending transversely through the first end of the at least one support bar;

a head support forming a second plane pivotally supported at the second end of the at least one support bar through a second pivot axis extending substantially parallel to the first pivot axis;

a back support supported by at least one of the head support and the at least one support bar proximate to the second pivot axis;

a third pivot axis formed between the back support and the head support and extending substantially perpendicular to the first pivot axis and the second pivot axis to allow the head support to rotate transversely to the first pivot axis and the second pivot axis; and wherein the back support is moveable with the at least one support bar and the head support relative to the frame and the seat to support a lower back of an individual seated on the seat through a range of motion undertaken by the individual during an abdominal exercise process causing rotation about the first pivot axis, the second pivot axis, and the third pivot axis.

2. The abdominal exercise machine of claim 1 wherein the at least one support bar is mounted to frame at first end proximate to the seat.

3. The abdominal exercise machine of claim 1 further comprising a resistive element configured to restrict rotation of the head support about the third pivot axis.

4. The abdominal exercise machine of claim 1 wherein the head support is configured to pivot about the first pivot axis and the second pivot axis between a first position where the first plane and the second plane are substantially coplanar and a second position where the first plane and the second plane are substantially perpendicular and further comprising a biasing element configured to restrict the head support against movement into the first position.

5. The abdominal exercise machine of claim 1 further comprising a foot restraint supported by the frame and configured to receive at least one foot of the individual seated on the seat and hold the at least one foot during the abdominal exercise process.

6. The abdominal exercise machine of claim 5 further comprising a fourth pivot axis extending substantially parallel to the first pivot axis and the second pivot axis and pivotally securing the foot restraint to the frame.

7. The abdominal exercise machine of claim 6 wherein the foot restraint is configured to allow independent movement of a first foot of the individual with respect to a second foot of the individual during the abdominal exercise process.

8. The abdominal exercise machine of claim 6 further comprising a resistive element configured to restrict pivotal movement of the foot restraint with respect to the frame.

9. The abdominal exercise machine of claim 1 wherein the first pivot axis, the second pivot axis, and the third pivot axis allow independent movement thereabout during the abdominal exercise process.

10. The abdominal exercise machine of claim 1 further comprising a pair of arms extending from opposing sides of the head support to allow the individual to hold the pair of arms and pull the head support in a direction generally toward the seat during the abdominal exercise process.

11. The abdominal exercise machine of claim 1 wherein the third pivot axis permits a twisting rotation of an abdomen of the individual during the abdominal exercise process.

12. An abdominal exercise machine comprising:

a frame supporting a seat forming a first plane;

at least one support bar extending from a first end to a second end and mounted to the frame through a first pivot axis extending transversely through the first end of the at least one support bar;

a head support forming a second plane pivotally supported at the second end of the at least one support bar through a second pivot axis extending substantially parallel to the first pivot axis;

a back support supported by between the head support and the at least one support bar proximate;

a third pivot axis formed between the back support and the head support and extending substantially perpendicular to the first pivot axis and the second pivot axis to allow the head support to rotate transversely to the first pivot axis and the second pivot axis; and wherein the back support is configured to remain engaged with a lower back of an individual seated on the seat as the individual moves through a range of motion undertaken during an abdominal exercise process including rotation about the first pivot axis, the second pivot axis, and the third pivot axis.

13. The abdominal exercise machine of claim 12 further comprising a resistive element configured to restrict rotation of the head support about the third pivot axis.

14. The abdominal exercise machine of claim 13 wherein the head support is rotatable about the third pivot axis between a first axial position and a second axial position and wherein the resistive element includes a spring biasing the head support at a midpoint substantially between the first axial position and the second axial position.

15. The abdominal exercise machine of claim 12 wherein the head support and at least one support bar are configured to pivot about the first pivot axis and the second pivot axis, respectively between a first position where the first plane and the second plane are substantially coplanar and a second position where the first plane and the second plane are substantially perpendicular during the abdominal exercise process.

16. The abdominal exercise machine of claim 15 and further comprising a biasing element configured to restrict the head support and at least one support bar against movement into the first position.

17. The abdominal exercise machine of claim 12 further comprising a foot restraint supported by the frame and configured to receive at least one foot of the individual seated on the seat and hold the at least one foot during the abdominal exercise process.

18. The abdominal exercise machine of claim 17 further comprising a fourth pivot axis extending substantially parallel to the first pivot axis and the second pivot axis and pivotally securing the foot restraint to the frame and wherein the foot restraint is configured to allow independent movement of a first foot of the individual with respect to a second foot of the individual during the abdominal exercise process.

19. The abdominal exercise machine of claim 12 wherein the third pivot axis permits a twisting rotation of an abdomen of the individual during the abdominal exercise process.

20. The abdominal exercise machine of claim 12 wherein the first pivot axis, the second pivot axis, and the third pivot axis extend linearly to allow bidirectional pivotal movement thereabout and restrict movement away from the bidirectional pivotal movement.

21. The abdominal exercise machine of claim 12 further comprising at least one of a fixed foot restraint supported by the frame and a pivotal foot restraint supported by the frame through a fourth pivot axis and biased one of toward the seat and away from the seat.

22. The abdominal exercise machine of claim 21 wherein the pivotal foot restraint includes independently pivotal foot holds configured to allow the individual to move one foot engaged with the foot restraint independently of another foot engaged with the foot restraint.

* * * * *